US009802196B2

(12) United States Patent
Taunk

(10) Patent No.: US 9,802,196 B2
(45) Date of Patent: Oct. 31, 2017

(54) ERGONOMIC NUMBERED CONNECTOR TO HOLD TUBES WITH IMPROVED CAP

(71) Applicant: Dale Singh Taunk, Fremont, CA (US)

(72) Inventor: Dale Singh Taunk, Fremont, CA (US)

(73) Assignee: AlphaGem Bio Inc., Newark, CA (US)

( * ) Notice: Subject to any disclaimer, the term of this patent is extended or adjusted under 35 U.S.C. 154(b) by 241 days.

(21) Appl. No.: 14/322,840

(22) Filed: Jul. 2, 2014

(65) Prior Publication Data

US 2014/0314638 A1 Oct. 23, 2014

Related U.S. Application Data

(63) Continuation-in-part of application No. 13/798,078, filed on Mar. 13, 2013, now Pat. No. 9,289,767.

(51) Int. Cl.
*B01L 3/00* (2006.01)
*B01L 7/00* (2006.01)

(52) U.S. Cl.
CPC ..... *B01L 3/5453* (2013.01); *B01L 3/50825* (2013.01); *B01L 3/50851* (2013.01); *B01L 7/52* (2013.01); *B01L 2200/0689* (2013.01); *B01L 2300/043* (2013.01); *B01L 2300/0654* (2013.01)

(58) Field of Classification Search
CPC ..... B01L 3/5457; B01L 3/50851; B01L 7/52; B65D 33/1633
See application file for complete search history.

(56) References Cited

U.S. PATENT DOCUMENTS 5,513,768 A * 5/1996 Smith ..... B01L 3/50825 215/278
5,683,659 A * 11/1997 Hovatter ..... B01L 3/5082 220/375
5,720,406 A * 2/1998 Fassbind ..... B01L 3/50851 220/23.4
5,863,791 A * 1/1999 Baldszun ..... B01L 3/50825 220/832
5,935,524 A * 8/1999 Bass ..... B01L 9/06 422/52
5,948,363 A * 9/1999 Gaillard ..... B01L 3/5085 422/552
D679,830 S * 4/2013 May ..... D24/224
D703,345 S * 4/2014 Tajima ..... D24/224
2003/0102323 A1* 6/2003 Lohn ..... B01L 3/50825 220/839
2003/0215365 A1* 11/2003 Sevigny ..... B01L 9/06 422/64

(Continued)

FOREIGN PATENT DOCUMENTS

IL WO 2013042105 A1 * 3/2013 ..... B01L 9/06

*Primary Examiner* — Jill Warden
*Assistant Examiner* — Benjamin R Whatley
(74) *Attorney, Agent, or Firm* — Geeta Kadambi; Riddhi IP LLC

(57) ABSTRACT

A lab consumable having a surface to display identifiers connected by a bridge encloses a tube. A specific sealer made up of hard and soft material is used close the tube. The connector for the sealer is made up of flexible, hard and various other material combinations. The surface where the identification is displayed has different surfaces and identifier. The identifier comprise of a number, alpha numerical, alphabets, symbol, barcode, customized sign, markings, hand written markings and a combination thereof.

9 Claims, 8 Drawing Sheets

(56) References Cited

U.S. PATENT DOCUMENTS

| | | | | |
|---|---|---|---|---|
| 2004/0092030 | A1* | 5/2004 | Bienhaus | B01L 3/5025 436/177 |
| 2004/0258563 | A1* | 12/2004 | Young | B01L 3/50825 422/400 |
| 2005/0276729 | A1* | 12/2005 | Helt | B01L 3/5085 422/400 |
| 2007/0017927 | A1* | 1/2007 | D'Amore | B01L 3/50825 220/752 |
| 2008/0257882 | A1* | 10/2008 | Turner | B01L 3/50853 220/23.2 |
| 2010/0059533 | A1* | 3/2010 | Unger | B01L 3/52 220/694 |
| 2011/0053208 | A1* | 3/2011 | Reiss | B01L 3/5453 435/29 |
| 2011/0085951 | A1* | 4/2011 | Nakahana | B01L 3/5082 422/549 |
| 2014/0178269 | A1* | 6/2014 | Zilberberg | B01L 9/06 422/562 |
| 2015/0376562 | A1* | 12/2015 | Baum | B01L 9/06 435/304.1 |

* cited by examiner

ERGONOMIC NUMBERED CONNECTOR TO HOLD TUBES WITH IMPROVED CAP

CROSS REFERENCE TO RELATED APPLICATION

The instant application is a continuation in part of a pending U.S. application Ser. No. 13/798,078 filed on 13 Mar. 2013. The pending U.S. application Ser. No. 13/798,078 is hereby incorporated by reference in its entireties for all of its teachings.

FIELD OF INVENTION

The present invention is generally directed to a lab consumable having a numbered connector to hold the tube in form of a strip and an improved cap strip having a top with optically clear surface for more accurate reading and ergonomic when used in the laboratory.

BACKGROUND

Performing biological research and diagnostics testing process of real-time polymerized chain reaction (PCR) products and other processes require a number of tubes and are used in multiples of 2, 4, 6, 8, 12 or 96 at a time. The tubes can be erroneously interchanged or the written numbers on them by markers may wash of or be smudged while using it in the laboratory. This creates a monetary loss and time loss for the researcher as they have to repeat the experiment all over again. The sides of the tube, which is made out of polypropylene, are inherently slick because of the properties of the material, and are sharply curved because of the small diameter of the tube, and as a result are difficult to write on. It has therefore always been necessary to include a label which is either adhesively stuck to the centrifuge tube or attached to it with a translucent adhesive tape. There is no solution but to number it on the tube or the cap while conducting experiments at this particular time. The problem with the prior art is that it has been impossible to conveniently write on a centrifuge tube, PCR tube or any other small lab process tube in a consistent manner to identify it. If the tag is placed on the side of the tube, it cannot be read in many cases without removing the tube from its holding rack or container. If the tag is not secured onto the side of the tube properly, the irregularity of the tag can make it difficult to insert or remove the tube from its holding rack or container. Tags glued to the tops or caps of the centrifuge tube are often torn off when the tube is opened. None of these tags prove to be a satisfactory solution to marking the tubes.

Another issue that a researcher faces is, for manual application of real-time PCR microtube caps a researcher will typically align the caps, strips or films and body of the PCR tubes and apply 1 to 3 pounds per $cm^2$ of pressure on top of caps with their hands, thumbs and finger or other device. This also changes the shape of the top surface that would be subsequently used for optical measurement. With the current designs of products available in the market for real-time PCR the lens of the sealing caps, strips and films come directly in contact with hands, thumbs, fingers or automated sealing devices and adversely effects the surface of the lens for optical clarity. Direct contact of this type is not desirable. We need a solution to overcome these shortcomings.

In automated capping and sealing film machines the sealing platform applies direct pressure and or heat to the lens area of the PCR caps strips and films directly contacting the lens area. This direct contact to the lens area through which light will pass and be used to gather the PCR reaction data is not desirable for the many reasons. There is a need for producing a more optically conducive microtube cap.

SUMMARY

The present disclosure describes a lab consumable with a numbered connector to hold the tube and an ergonomically improved sealing cap with clear optical surface. Using such lab consumable with tube assemblies in biological reactions effectively prevents miss managing the samples in the tubes due to improper labelling, leaks, reduces loss of reaction volume due to better sealing and an optically clear surface on top for accurately reading of concentrations at the end of the experiment.

Accordingly, in a first aspect, the present invention provides a lab consumable assembly which comprises of a hollow vessel body having a substantially cylindrical upper wall section defining at its edge portion the opening of the vessel body as a tube, a numbered connector to connect the tubes in numerical order and cap having an ergonomic cap connector to form a strip of cap with recessed top for optical clarity.

In another embodiment, the lab consumable when assembled also has a cap comprising a substantially cylindrically shaped member (an inner ring) made up of soft material which is insertable through the opening of the tube body into the tube body and engages the upper ring section to hermetically seal the tube body.

In one embodiment, an ergonomic cap connector with a flexible bridge made up of different materials is disclosed. The ergonomic cap connector has multiple caps attached to it to hermitically seal the tube. The upper ring that is formed higher than the inner ring is firmer than the inner ring which is lower than the upper ring. The inner ring is made up of soft material so that the insertion to the tube cavity, residing in tube body, is easy and the user does not have to use much pressure during repeat actions. The ergonomic cap connector is connected by bridges which also has a soft material to connect each cap. The bridge can be made using several materials.

In one embodiment, a numbered connector is disclosed that connects several tubes in numerical order. A number is displayed on a specific surface that is raised on the numbered connector. The numbers may be etched, made as a hollow space depicting numbers and as a raised format to designate numbers for each tube. In this disclosure a number may comprise of a number, alpha numerical, alphabets, symbol, barcode, customized sign, markings, hand written markings and a combination thereof. In another embodiment, ring structure connected to the specific number surface and the bridge that connects the set of numbered surface and the ring connect to each other to form a strip is described. The ring also accommodates and secures the tubes inside so that they do not move or tilt during routine laboratory use.

In one embodiment, a method for using the lab consumable is described. The tubes are inserted into the rings of the numbered connector and then the cap strip is fixed on each tube to secure the contents of the tube. Due to two bridges that connect the numbered connector and the cap strip the tubes are rigidly supported and do not lose their orientation or get misplaced. The numbering of the specific surface (number surface) helps the user to identify and correctly record the samples without the samples being misplaced or misnumbered.

The product and method of using the product disclosed herein may be implemented in any means for achieving various aspects. Other features will be apparent from the accompanying drawings and from the detailed description that follows.

BRIEF DESCRIPTION OF THE DRAWINGS

Example embodiments are illustrated by way of example and not limitation in the figures of the accompanying drawings, in which like references indicate similar elements and in which.

Other features of the present embodiments will be apparent from accompanying the detailed description that follows.

DETAILED DESCRIPTION

This invention relates to integration of three major components that form a part of the lab consumable. The three main components are, a hollow vessel body having a substantially cylindrical upper wall section defining at its edge portion the opening of the vessel body in essence called a tube, a numbered connector having a raised surface to display the numbers and a bridge to connect the tubes in numerical order and cap having an ergonomic cap connector to form a strip of cap with recessed top for optical clarity.

Figure 1:
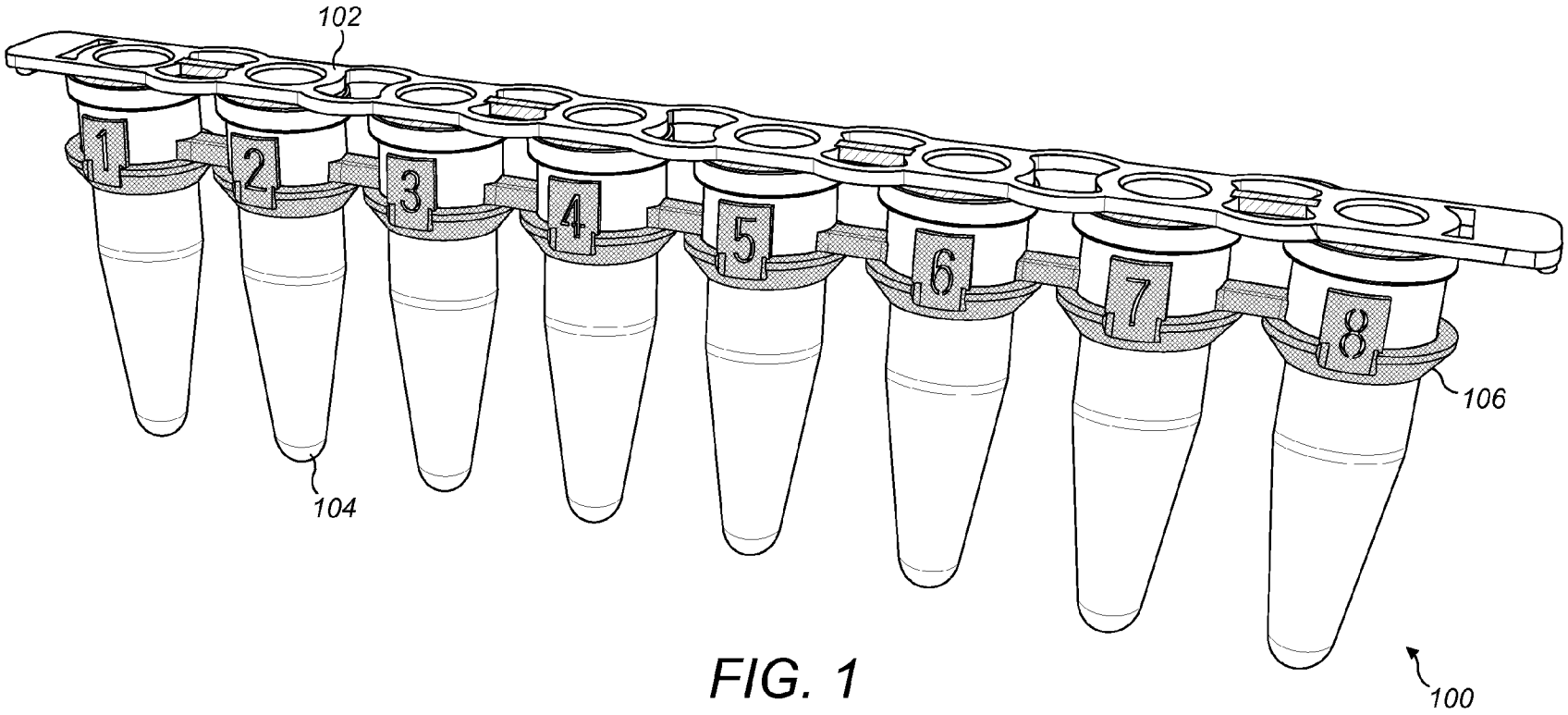
FIG. 1 is a view of series of tubes attached through a numbered connector and ergonomic strip of cap 100.

FIG. 1 shows a brief overview of the lab consumable 100. Lab consumable 100 comprises of three parts. A cap with ergonomic cap connector 102 is shown as a strip and the cap tops have inundations. The numbered connector 106 holds the tubes 104 in numbered order. The numbered connector 106 has a raised surface to display the numbers (number surface). The tube 104 has a cylindrical body with an opening to receive the strip cap 102. Each component will be described in detail in the following description and supporting figures. A lab consumable comprises of a numbered connector to connect the tube in numerical order, wherein the numbered connector consists of a bridge, a number surface to host a marking and a ring to accommodate the tube; and a cap having an ergonomic cap connector to form a strip of cap with recessed top for optical clarity and a sealer for the tube. The sealer has an outer edge ring that is an extension of an inner support ring to close the tube, wherein the outer edge ring is made up of a soft material.

Figure 2:
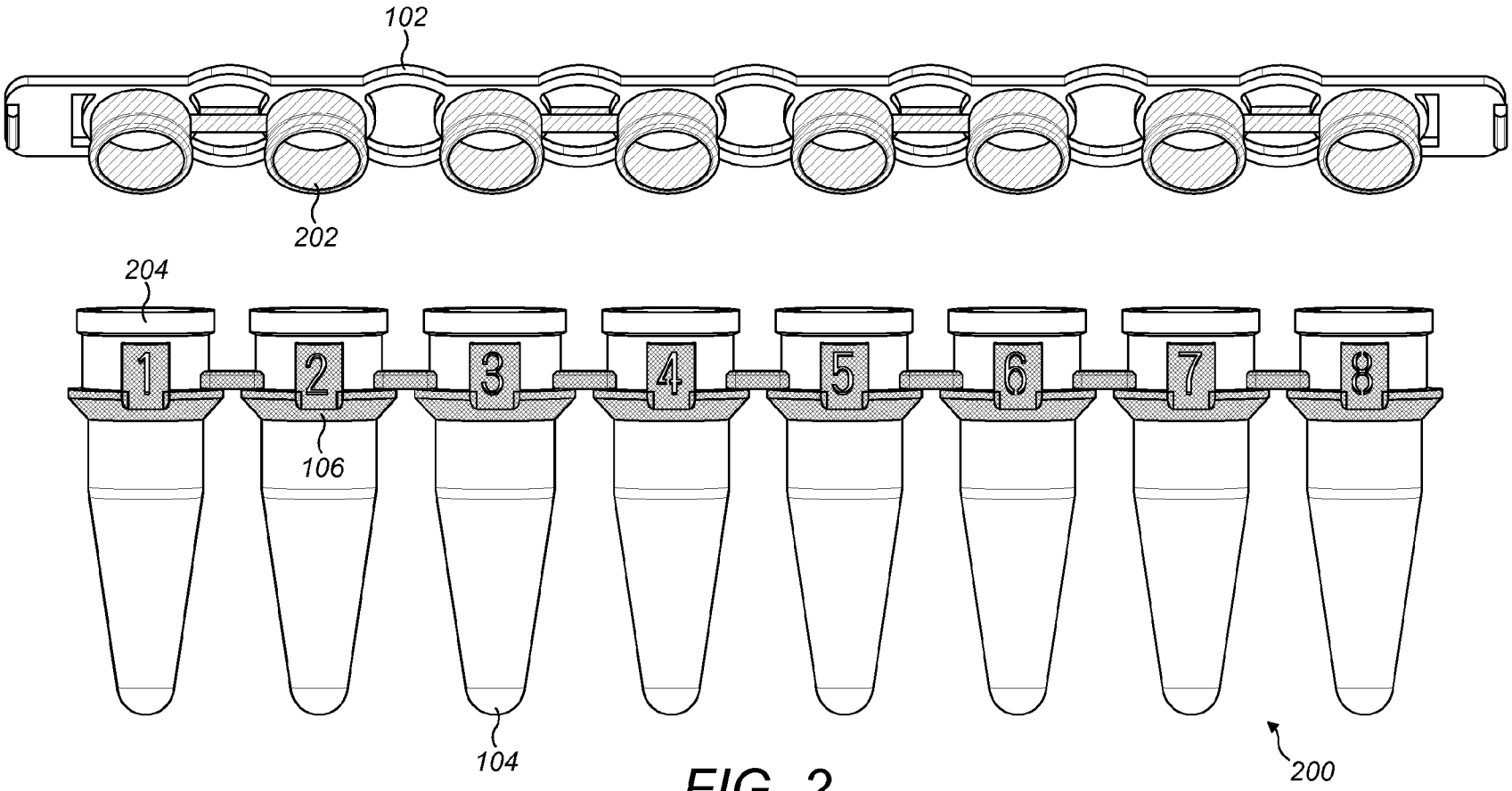
FIG. 2 is a view 200 of tube attached through the numbered connector separated from the ergonomic strip of cap.

FIG. 2 is a view 200 of tube 104 attached through the numbered connector 106 separated from the ergonomic strip of cap 102. The strip cap 102 has an insert tab 202 that may be made up of soft materials such as thermoplastic elastomers. Insert tab 202 also has various parts and will be discussed below. The insert tab 202 of the strip cap 102 is used to close the opening 204 of the tube 104. The circumference of the insert tab 202 is smaller compared to the opening 204 of the tube 104. The softer material such as thermoplastic elastomer makes it ergonomically easy for the user to close the tube part 204 using insert tab 202. Since the thermoplastic elastomers lends itself to be snug the tube 104 is hermitically sealed during routine laboratory heating, cooling and machine processing making this design of lab consumable the most efficient design to prevent sample loss.

Figure 3:
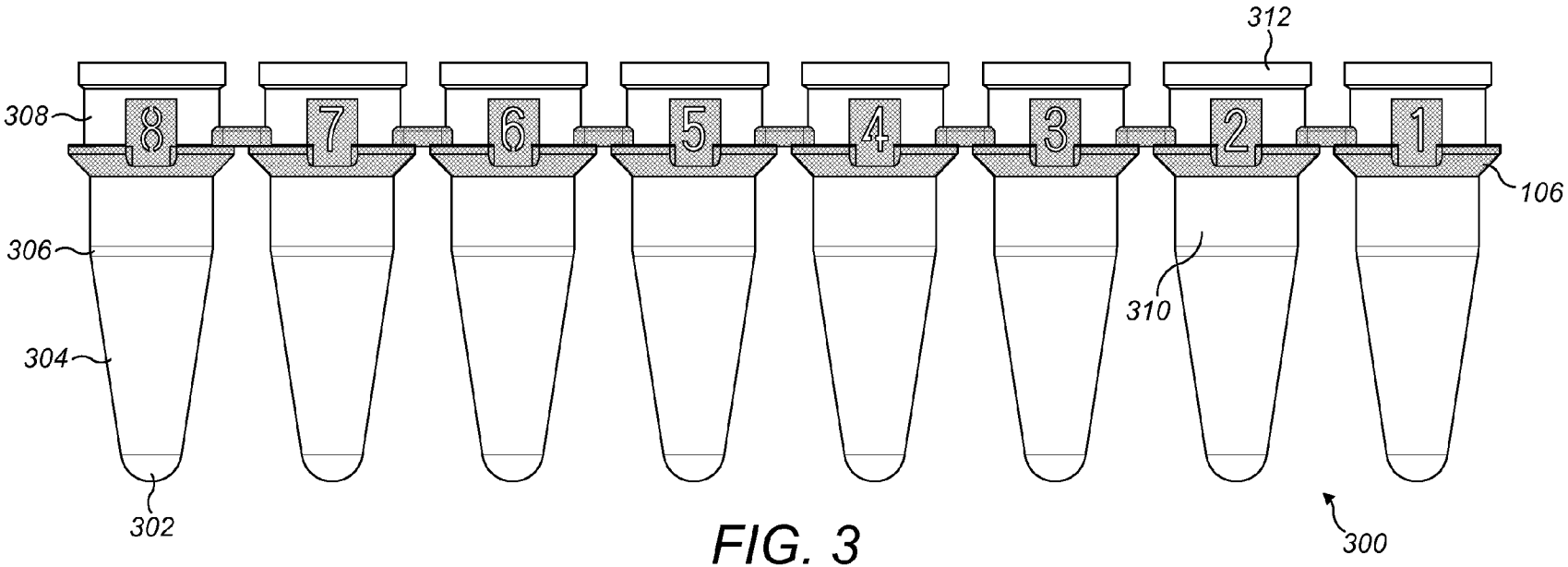
FIG. 3 is view 300 of tube attached by the numbered connector.

FIG. 3 is view of tube attached by the numbered connector 300. FIG. 3 shows various parts of the tube 104. The tube has a narrow end 302 that can hold a small amount of samples as low as 0.1 ul to 0.25 ul. The conical part 304 helps hold more sample as the structure increases gradually to the top and stabilizes at the rigid ring level 306. The rigid ring 306 gives structural integrity to the conical structure 304 of the tube. The upper part of the tube is made up of a cylindrical structure 308 and 310. The cylindrical structure 308 is higher than the numbered connector 106 and the cylindrical structure 310 is below the numbered connector 310. This provides a stable insert for the ring of numbered connector 106 and will be discussed later. Tube part 202 houses tube ring 312. The entire 104 tube is made up of materials such as polypropylene, biodegradable materials, combinations of various polymers etc. The tube 104 may be molded using different materials such as the lower conical structure 304, the rigid ring 306, the cylindrical part 310 and 308 may be of one material and to increase the sealing property the tube ring on the outer part may be made of more rigid polymer to withstand repeated opening and closing movements by the user and to not to lose the integrity due to various lab conditions such as heating and cooling. The size of the tube is for holding 0.01 ul to 0.20 ml of sample. They are essentially tubes for performing PCR, Q-PCR, RT-PCR like experiments in the lab. They need to be accommodated in special holders for centrifugation and other mechanical procedures in the lab.

Figure 4:
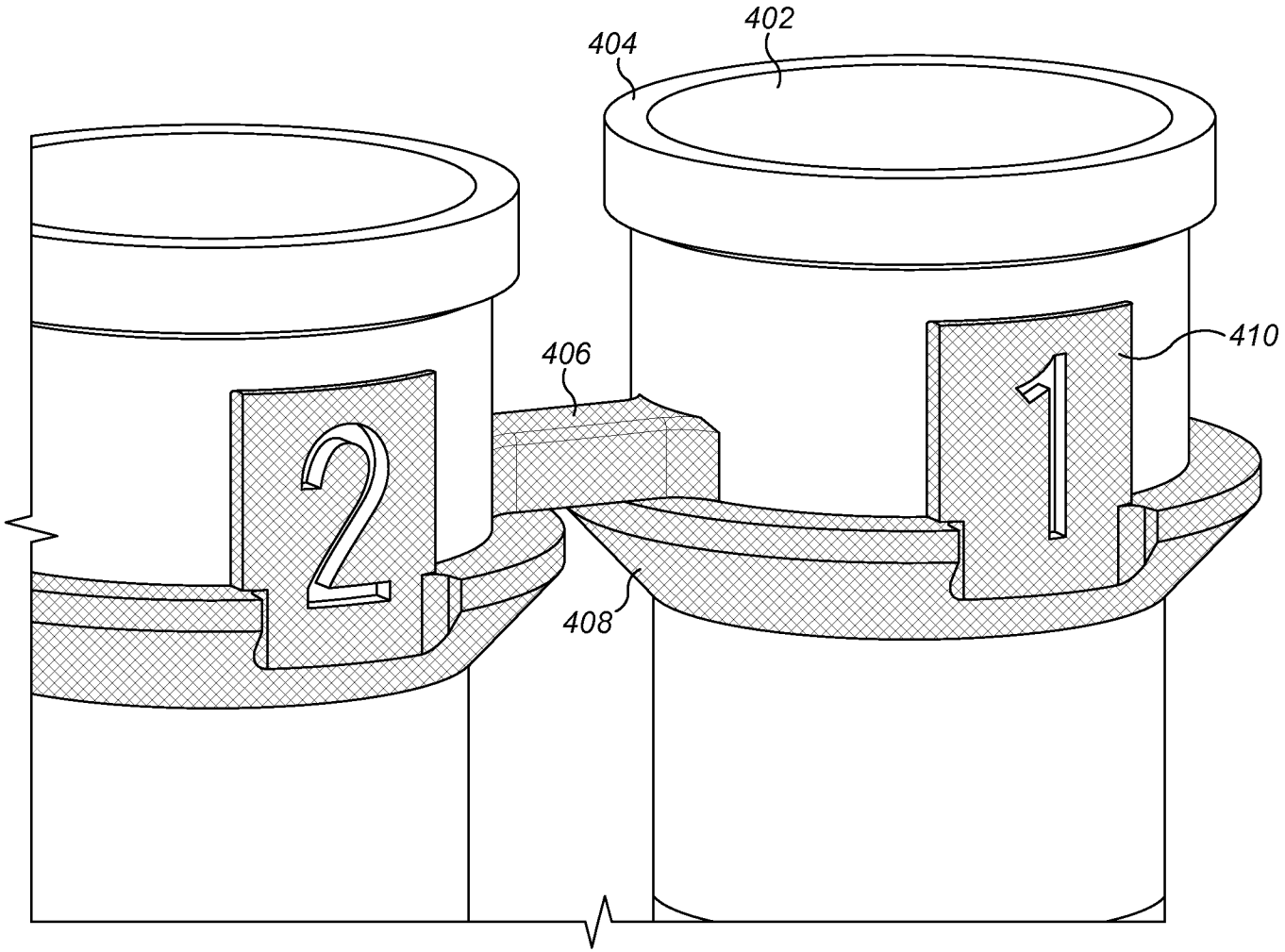
FIG. 4 is the close up view of the numbered connector.

FIG. 4 shows the details of the receiving tube opening 204 and the tube ring 312. The outer lip 404 is a flat surface that provides structural integrity to the opening that receives the tube insert from the tube cap. The inner surface 402 is a smooth surface that enables the insert tab 202 to seal hermitically. The numbered connector has three parts. The bridge 406 connects the ring 408 with each other. The ring also houses the raised numbered surface 410. The numbered connector 106 is made up of a thermoplastic elastomer. However, the bridge 406 may also be made of more rigid materials and/or combination of polymers, soft material, combination of soft and hard material. The ring 408 has a conical surface. The narrower surface connects with the tube 104 and the wider surface provides a wider base for the bridge to sit and connect with the ring. The adjacent rings 408 are separated so that the bridge 406 is flexible and provides ergonomic comfort to the user for inserting and handling the tubes. The bridge 406 may be molded into the rings, or made to slide into the connection, or snap fit to each ring as the requirement for the tubes as a tube strip needs to be increased. The entire three parts may be made up of individual units that comprises of three parts such as the ring, the raised number surface and the ring. They may be connected to each other by connecting the bridges as a snap on fit or a slide fit by connecting at the ring. The flexible bridge connects the number surface and the tube in sequential order.

Figure 5:
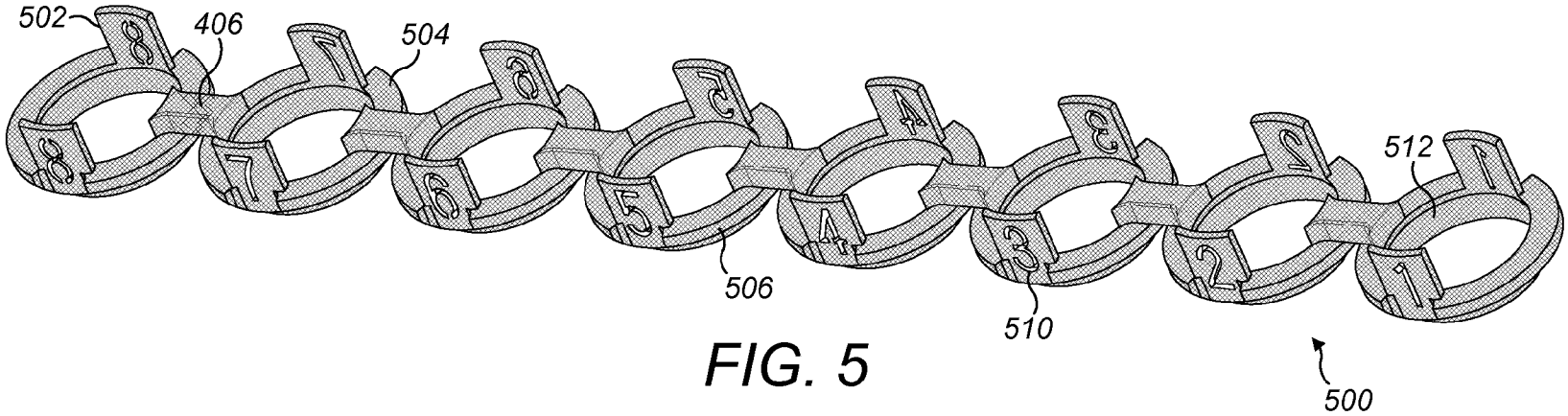
FIG. 5 is the detailed top view 500 of the numbered connector 106.

FIG. 5 shows the detailed top view 500 of the numbered connector 106. One unit of the numbered connector 106 comprises of a ring 506, a raised numbered surface 410 and a bridge 406. The ring 506 has an outer part 504 and an inner part 512. The outer part 504 provides support for the bridge 406 and raised numbered structure 410. It wide and horizontal to the inner part 512. The inner part 512 has an inclined slope to fit snugly to the tube 104 and does not allow the tube to shake sideways. The inner part 512 provides a support to the outer part 504 to be housed on it. The number surface 410 in the numbered connector is at least one of a hollow and raised format. The number 510 on the number surface 502 can be made up of illuminated material, raised surface or carved on the surface. There may be one numbered surface or two numbered surface for each ring. The numbered surface 502 are fixed on the ring, they be made as an insertable tab or molded with the ring. The number surface may also allow other markings such as alphabets and raised surfaces for customization. The number surface in the numbered connector is at least one of a hollow and raised format. The number surface in the single numbered connector uses a single color or the number is in one color and the back ground is another color.

Figure 6:
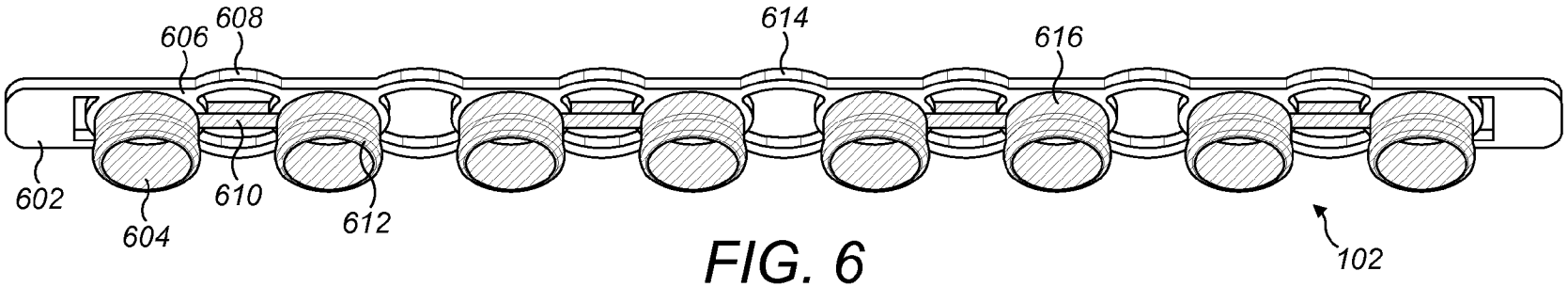
FIG. 6 shows the detailed view of the strip cap 102.

FIG. 6 shows the detailed view of the strip cap 102. The strip cap 102 is multiples of the single cap that fit the tube 104 and seals it hermitically. The end 602 is extended out portion that enables the user to separate the strip cap 102 from the tube 104. The sealer has three parts has an inner surface, outer edge ring and back support. The inner surface 604 for the sealer has a smooth surface; the outer edge ring 612 is an extension of the inner support ring 616 to close the tube, wherein the outer edge ring 612 is made up of soft material such as thermoplastic elastomers (material one). The back support 606 for the sealer is made up of a hard material so the rigidity of the cap is maintained. The flexible bridge at the lower portion 610 may be made up of the same material as the upper material or a softer material than the upper portion of the bridge. This would enable a person to cut the section from these parts and use the cap as individual caps for individual tubes such as PCR tubes, Q-PCR tubes, RT-PCR tubes, Eppendorf tubes and microcentrifuge tubes. Section 614 (bridge) and 608 as shown in the figures as part of the bridge shows they are important for structural integrity of the cap. The serrated part 608 may permit the user to cut through the serration so that they can use that as an individual cap. The bridge 614 shows it a continuous structure which has serrations on bridge 614. This part of the cap is made up of hard material such as polypropylene. Another way to describe the ergonomic sealer is that it has an outer edge ring that is an extension of an inner support ring to close the tube, wherein the outer edge ring is made up of a soft material.

Figure 7:
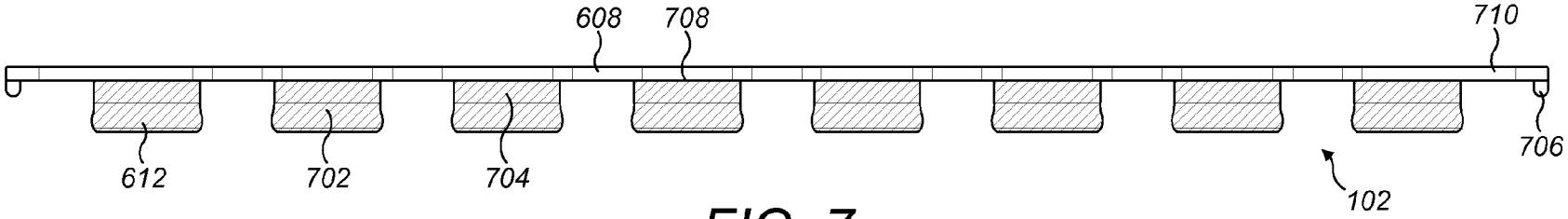
FIG. 7 shows the side view of the strip cap 102.

FIG. 7 shows the side view of the strip cap 102. This figure describes another embodiment of the structure of the sealer. The sealer may be made up many layered ring structure such as 612, 712, 704 and the base 708. They may be molded to be made from the same material having the same circumference to different circumferences. The may be made up of same soft material or may be a combination of soft and hard materials. For example, 162 part may the softest material and the 708 may the hardest material with 702 and 704 having a medium softness material in them. The purpose for varying the material softness is to allow the temperature driven experiments to complete without loss of samples. The flexibility of the lower softer material may help expand when it is hot but the rigidity of the base layer may allow sealing to be better. On the other hand if the cold storage would shrink the material then the gradient would help keep the seal quality intact due to expansion and contraction of the cap material. This is a technically superior design than existing technology as it requires precise calculations and correct material selection for blend and molding. The cap ends 710 and a projected lip 706 are designed to be ergonomically useful for user. They are made of the hard material polypropylene (material two) similar to what 608 is made up of.

Figure 8:
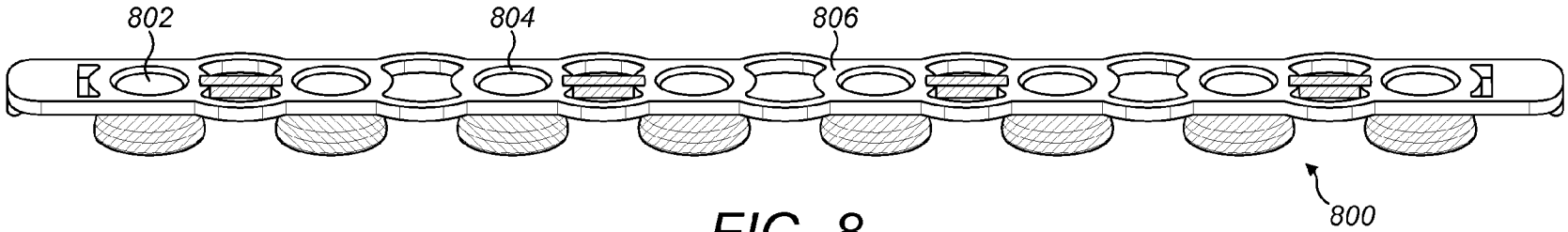
FIG. 8 shows a top view of the strip cap 800.
Figure 9:
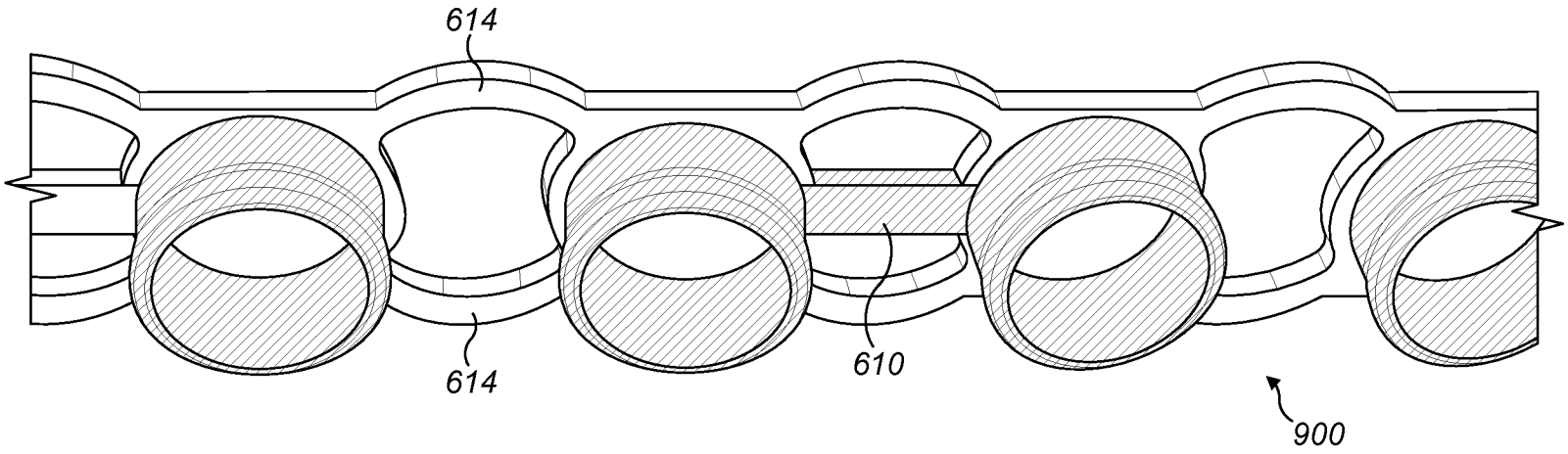
FIG. 9 shows a detailed view of the strip cap connector 900.

FIG. 8 shows a top view of the strip cap 800. It shows in detail the upper portion of the inner ring 802 recessed cap. The ridge 804 that surrounds and connects the recessed part to the upper ring 806. The inner ring 802 is shown to have a shape. It could flat, concave or smooth. The cap having an inner ring 802 that is lower than an upper ring 806 and is made of an optically clear material. The strip cap may have several configurations. The strip cap may be a single cap, multiple strip caps such as 2, 4, 6, 8, 10, 12, 24, 36, 96 and 108 and 364 and may form a strip to accommodate these configurations. The strip cap may be individual strip cap or attached by the bridge to make a strip of caps for multiple configurations. FIG. 9 shows a detailed view of the strip cap connector 900. The details of the more enlarged picture have been discussed in the description of FIG. 6.

Figure 10:
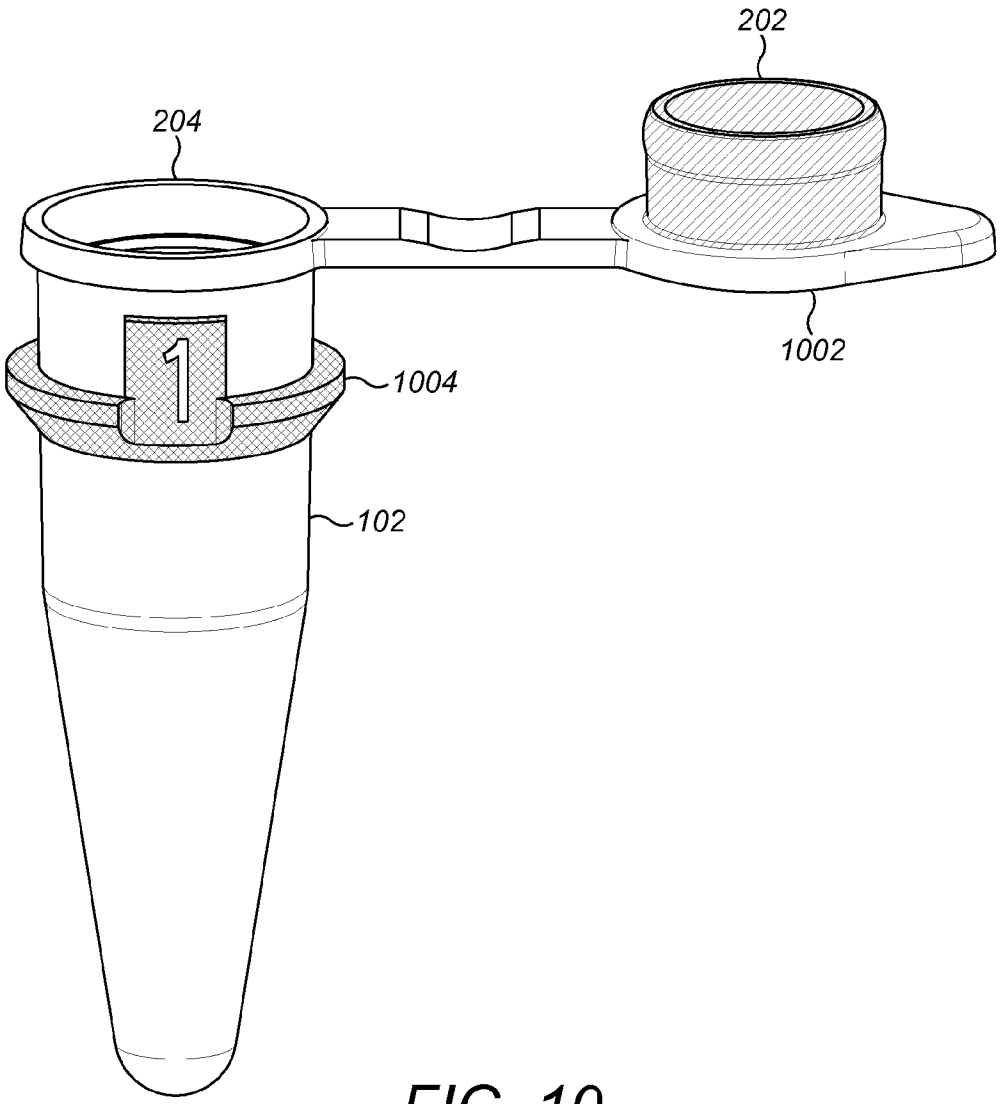
FIG. 10 shows an individual tube with a soft cap and numbered surface.

FIG. 10 shows the individual tube 102 with a single cap 202 that is made of soft material attached to a lid 1002. Lid 1002 has an indented top as shown in FIG. 8 (802, 804) with optically clear material for superior readings. The soft cap 202 is designed to fit to the opening 204 of the tube and seal it hermitically. A single numbered connector with its ring 1004 and with or without the bridge and a raised numbered surface may be used to label the tube for numerical recognition. The bridge might enable the user to add on more tubes by connecting the bridges that have snap on to slide addition ability.

The method of making the single or multiple tubes with cap and numbered connector bridge may be done using typical state-of-the-art manufacturing processes for two materials/two color molding is accomplished by plastic injection molding at approximately 220° C.-250° C. The first material, typically a rigid material such as polypropylene plastic pellets (material two) are fed into a hopper, melted within a heated screw of the Injection molding machine and injected into the mold/die. The first molded part is then moved over into a second injection mold and is typically over molded or co molded with the second material. After a cooling period, typically 10 to 20 seconds the co-molded part is ejected out of the mold and the process is repeated.

In addition, it will be appreciated that the various embodiments, materials, and designs can be interchangeable used in the current embodiments and various combinations of the article of use. Accordingly, the specification and drawings are to be regarded in an illustrative rather than a restrictive sense.

What is claimed is:

1. A lab consumable, comprising:

multiple tubes in the form of a hollow vessel with an edge portion as an opening, wherein the opening has a smooth surface;

a connector to connect and hold the multiple tubes consisting of a bridge connecting rings holding the multiple tubes together, each one of the rings having a raised surface to host a marking and a conical surface, wherein the conical surface has a wider part and a narrower part, wherein the narrower part is inclined and shaped narrower than the wider part to accommodate the tube and the wider part houses the raised surface; and a strip cap connector which has a bridge to form strips of caps and each cap having a sealer for each of the multiple tubes wherein each sealer has many layered rings of at least one of the same circumference and different circumference and made up of a soft material to provide flexibility and a hard material to provide rigidity to the sealer when used for covering the multiple tubes, wherein the layered rings have an outer edge ring that is made up of the soft material and an inner support ring, wherein the bridge of the strip cap connector has a serrated part and a flexible bridge each of the serrated part and flexible bridge each separately connecting the multiple caps together.

2. The lab consumable of claim 1, wherein the strip cap connector is made of at least one of a material one, material two and combination of material one and two.

3. The lab consumable of claim 1, further comprising; the raised surface of the connector has at least one of a hollow and raised portion.

4. The lab consumable of claim 1, wherein the raised surface of the connector displays at least one of a number, alpha-numeric, barcode, customized sign, markings, hand written markings and a combination thereof.

5. The lab consumable of claim 1, wherein the bridge on the strip cap connector is made up of polypropylene, or thermoplastic elastomer.

6. The lab consumable of claim 1, wherein the outer edge ring accommodates the tube and holds the tube in a secure position when a user is performing their lab testing, wherein the strip cap is at least one of 2, 4, 6, 8, 10, 12, 24, 36, 48, 96, 108 and 364 cap configuration.

7. The lab consumable as in claim 1, wherein the bridge on the strip cap connector is made of at least one of a single material or dual material.

8. The lab consumable as in claim 1, wherein the sealer on the cap used to seal the tube is made up of the soft material.

9. The lab consumable as in claim 8, wherein the outer part of the layered rings is an extension of an inner support ring to close the tube, wherein the outer part the layered rings is made up of the soft material, wherein the strip cap is at least one of 2, 4, 6, 8, 10, 12, 24, 36, 96, 108 and 364 cap configuration.

* * * * *